US007578022B1

(12) United States Patent
Schraga

(10) Patent No.: US 7,578,022 B1
(45) Date of Patent: Aug. 25, 2009

(54) BRISTLE ORIENTATION ASSEMBLY FOR A TOOTHBRUSH

(76) Inventor: Steven Schraga, 9433 Byron Ave., Surfside, FL (US) 33154

( * ) Notice: Subject to any disclaimer, the term of this patent is extended or adjusted under 35 U.S.C. 154(b) by 0 days.

(21) Appl. No.: 11/801,126

(22) Filed: May 8, 2007

Related U.S. Application Data

(62) Division of application No. 10/337,222, filed on Jan. 6, 2003, now Pat. No. 7,213,293.

(51) Int. Cl.
*A46B 15/00* (2006.01)

(52) U.S. Cl. ..... 15/167.1; 15/22.1; 15/201; 15/169

(58) Field of Classification Search ..... 15/167.1, 15/169, 184, 203, 172, 201, 186, 22.1; 132/119
See application file for complete search history.

(56) References Cited

U.S. PATENT DOCUMENTS

| | | | | |
|---|---|---|---|---|
| 1,592,207 | A | | 7/1926 | Havrilla |
| 2,144,408 | A | | 1/1939 | Holmes |
| 2,864,111 | A | | 12/1958 | Rotceig |
| 3,110,053 | A | | 11/1963 | Surabian |
| 3,737,936 | A | | 6/1973 | Uosaki |
| 3,803,663 | A | | 4/1974 | Weihrauch |
| 4,149,293 | A | | 4/1979 | Raaf et al. |
| 4,152,806 | A | | 5/1979 | Raaf et al. |
| 4,860,692 | A | | 8/1989 | Beard |
| 5,033,154 | A | | 7/1991 | Marchand et al. |
| 5,142,726 | A | | 9/1992 | Mann |
| 5,274,870 | A | | 1/1994 | Stollman |
| 5,357,644 | A | | 10/1994 | Theriault |
| 5,407,254 | A | | 4/1995 | Hegemann |
| 5,435,032 | A | | 7/1995 | McDougall |
| 5,528,786 | A | | 6/1996 | Porat et al. |
| 5,651,158 | A | | 7/1997 | Halm |
| 5,815,875 | A | | 10/1998 | Yamada |
| 5,839,148 | A | * | 11/1998 | Volpenhein ..... 15/167.1 |
| 5,974,613 | A | | 11/1999 | Herzog |
| 6,453,497 | B1 | | 9/2002 | Chiang et al. |
| 7,213,293 | B1 | | 5/2007 | Schraga |

FOREIGN PATENT DOCUMENTS

| | | |
|---|---|---|
| FR | 1166163 | 6/1958 |

* cited by examiner

*Primary Examiner*—Gary K Graham
(74) *Attorney, Agent, or Firm*—Malloy & Malloy, P.A.

(57) ABSTRACT

An assembly structured to be used primarily, but not exclusively, with a toothbrush and cooperatively structured therewith to selectively orient the bristles of bristle tufts of the brush between a neutral position, an angularly oriented forward position and/or a angularly oriented rearward direction. A position assembly is connected to the body of the toothbrush and reciprocally moveable along the length thereof in a manner which substantially maintains the longitudinal axises of both the body of the toothbrush and the positioning assembly in parallel relation to one another. The position assembly including a bristle engaging portion with may be mounted either exteriorly or interiorly of the head portion of the toothbrush body and cooperatively structured therewith to selectively orient the plurality of bristles in any of the above noted positions.

9 Claims, 4 Drawing Sheets

BRISTLE ORIENTATION ASSEMBLY FOR A TOOTHBRUSH

CLAIM OF PRIORITY

The present application is a "divisional" utility patent application filed Jan. 6, 2003, having Ser. No. 10/337,222 also incorporated herein by reference, which will mature into U.S. Pat. No. 7,213,293 on May 8, 2007.

BACKGROUND OF THE INVENTION

1. Field of the Invention

This invention relates to a toothbrush or other type brush incorporating a positioning assembly for selectively disposing the bristles of the brush in a neutral position or, alternatively, in a plurality of angular orientations more specifically described as being angularly oriented in a forward direction or in a rearward direction relative to the length of the toothbrush. Positioning of the bristles in the manner described thereby further facilitates reaching all parts of the interior of the mouth including the gums, teeth, and other exposed areas.

2. Description of the Related Art

The use of the toothbrush in various forms, structures, and configurations, has been a widely accepted practice throughout the world for many years. In modern times an emphasis on dental care has led to numerous structural and functional modifications of the toothbrush in order to better facilitate dental hygiene.

Some of the more sophisticated and complex modifications of toothbrush structures include "fountain" type devices, wherein a supply of toothpaste or like dentifrice is contained within and dispensed from interior portions of the brush. More practical and commercially successful modifications have been directed to the structure, texture, location, and orientation of the plurality of bristles or bristle tufts secured to the head portion of the toothbrush. Somewhat recent advances of toothbrush technology include the collective shaping or configuration of the plurality of bristles so they may better reach all areas of the oral cavity including the individual teeth, as well as the gums.

Another factor commonly considered in the design and structuring of a toothbrush is the hardness of the plurality of bristles. Previously, bristle hardness was at least partially based on the material from with the bristles were formed. Alternatively, bristle hardness was regulated by the dimensioning of the individual bristles and/or the quantity of bristles secured to the toothbrush head. However, in these latter structures the array of bristles were permanently secured to the head portion of the toothbrush in a non-variable position and/or orientation. The practical result of such modified structure was the manufacturing and selling of a variety of different toothbrush categories, wherein each category was represented by a specific bristle hardness. Once chosen by a consumer, the realization of unsatisfactory hardness could only be overcome by purchasing a new toothbrush with a different degree of bristle hardness.

More recent developments intended to overcome the above set forth problems were directed to toothbrush structures which enabled the selective adjustment of bristle hardness by regulating the length of the bristle. It was soon apparent that devices could be cooperatively structured with a toothbrush, as well as the bristles secured there too, which were capable of varying the length of the bristle array and a change in the bristle hardness. More specifically, the shorter the bristle being applied to the teeth and/or gums of the user, the greater the intensity added to the cleaning procedure. The hardness and thus the cleaning power of the bristles were therefore directly attributed to their length. The selective controlling of the bristle length of the user added to the versatility of the toothbrush. Also the manufacturing of a larger number of toothbrushes segregated into various categories of hardness would no longer be required.

While structural modification and design intended to accomplish adjustable operative features of the toothbrush were accepted in theory, the development of a practical structure to be incorporated into a toothbrush was soon found to be more problematic. Further, structural and operational modifications were infrequently directed to the problem of developing a more efficient toothbrush specifically intended to facilitate the reaching of virtually all areas of the teeth, gums, and other exposed surfaces of the oral cavity.

Accordingly, there is a need in the industry related to toothbrush manufacture and design for an assembly structured to selectively vary the orientation of the plurality of bristles into a variety of different positions which enable the user to better reach and engage the various teeth, gums, and other exposed surfaces of the mouth in order to better maintain superior dental hygiene. Such an improved modification, while being clearly distinguishable from prior structures would allow for the selective and variable orientation of the plurality of bristles in a quick and easy manner. Such a preferred toothbrush structure incorporating a bristle positioning assembly would be relatively uncomplicated and therefore inexpensive to produce. The costs thereof could be maintained well within the parameters of the average consumer. Moreover, the preferred combined toothbrush and positioning assembly should be durable, long-lasting and sufficiently simply from an operational standpoint to be used by consumers of all ages.

SUMMARY OF THE INVENTION

The present invention is directed to a toothbrush or other brush structure incorporating a bristle orientation assembly. More specifically, the bristle orientation assembly is cooperatively structured with the brush structure on which it is mounted to selectively dispose the plurality of bristles into any one of a plurality of different operative positions. Each operative position, as set forth in greater detail hereinafter, is intended to facilitate engagement and contact of the bristles with different portions of the mouth including the teeth, gums, and other exposed surfaces of the oral cavity. As such, the aforementioned operative positions specifically include, but are not limited to, a neutral position, wherein the bristles extend outwardly from the head of the toothbrush in a substantially perpendicular orientation, as in conventional toothbrush construction. Another of the plurality of operative positions include the angular orientation of the plurality of bristles in a forwardly facing direction relative to the length of the toothbrush body. Conversely, another of the plurality of operative positions comprises an angular orientation of the plurality of bristles in a rearwardly facing direction relative to the length of the toothbrush.

To accomplish the selective positioning of the plurality of bristles in any of the plurality of operative positions, the bristle orientation of the present invention comprises a positioning assembly connected to the body of the toothbrush and reciprocally moveable on or within the body along the length thereof. The positioning assembly preferably includes an elongated configuration which may be substantially equal to or somewhat less than the length of the toothbrush body. Cooperative structuring between the toothbrush assembly and the toothbrush body enables the positioning assembly to accomplish the aforementioned reciprocal movement or travel in a manner which maintains the longitudinal axis of positioning assembly in parallel relation to the longitudinal axis of the toothbrush body.

Additional structural features include the bristle engaging portion connected to or made a part of the positioning assembly and moveable therewith in a reciprocal fashion relative to the length of the toothbrush body. Further, in each of the preferred embodiments of the bristle orientation assembly, the bristle engaging portion of the positioning assembly is cooperatively disposed and structured relative to both the head portion of the toothbrush body and the plurality of bristles, to effectively accomplish selective positioning of the bristles into any of the aforementioned operative positions. Structural variations in the plurality of preferred embodiments of the present invention comprise the bristle engaging portion moveably mounted on or connected to an exterior of the toothbrush body in overlying or other cooperative positions relative to the head portion of the toothbrush body. Alternatively, another preferred embodiment of the positioning assembly is its mounting on or connecting to the toothbrush body on the interior thereof such that the bristle engaging portion moves longitudinally within the head portion of the toothbrush body.

Dependent upon the particular preferred embodiment of the positioning assembly utilized, either the bristle engaging portion or the head portion of the toothbrush body includes an apertured construction. More specifically, exteriorly mounting the positioning assembly and bristle engaging portion on the toothbrush body includes the bristle engaging portion having the apertured construction. The apertured construction comprises a plurality of openings, through which the plurality of bristles, or bristle tufts extend. Further, in this embodiment the bristle tufts are fixedly secured, at their base to the head portion of the toothbrush body in a somewhat conventional structural configuration.

In contrast the mounting or connection of the bristle engaging portion on the interior of the head portion of the toothbrush body locates the apertured construction within the exteriorly disposed head portion. As with the previously described embodiment, the apertured construction comprises a plurality of openings through which the plurality of bristles or bristle tufts extend. Moreover in this embodiment the base ends of the bristle tufts are fixedly and permanently secured to the bristle engaging portion rather than the head portion of the toothbrush body.

Selective orientation of the bristles into the various operative positions is further facilitated by an adjustment assembly connected to both the toothbrush body and the positioning assembly. The adjustment assembly is readily accessible by the hand of the user as the handle of the toothbrush body is gripped in a somewhat conventional fashion. The adjustment assembly comprises a plurality of different preferred embodiments each structurally adapted to move the positioning assembly relative to the toothbrush body, dependent upon the particular preferred embodiment utilized as described above.

While the bristle orientation assembly of the present invention is described herein with primary reference to the structure and operation of a toothbrush, it is emphasized that with little or no structural modification, the various preferred embodiments of the bristle orientation assembly of the present invention can be utilized to selectively position the bristles of a variety of different brushes for purposes of disposing a plurality of bristles thereon in any of a number of operative positions as best suits the particular application for which a brush structure is intended.

These and other objects, features and advantages of the present invention will become more clear when the drawings as well as the detailed description are taken into consideration.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

As shown in the accompanying figures the bristle orientation assembly of the present invention comprises a plurality of preferred embodiments each operative to selectively dispose the plurality of bristles of a toothbrush, or other brush structure, in any one of a plurality of operative positions. For purposes of clarity, it is to be understood that when referring to a "plurality of bristles", such bristles may in fact be individually secured to the toothbrush or other brush assembly or be provided in the form of bristle tufts. Each of a plurality of bristle tufts may include a number of bristles, arranged in groupings, wherein the individual groupings or tufts are collectively disposed in a predetermined array. Typically the array of bristles or bristle tufts may comprise a plurality of columns extending along a length of the head portion of the brush body and/or a plurality of rows extending transversely of the length of the head portion of the brush body. However, when referring to the bristles or the plurality of bristle tufts, the various embodiments of the present invention are not intended to be limited to any specific number, array, or dimensional parameters in which the plurality of bristles, bristle tufts, etc. may be disposed.

Figure 1:
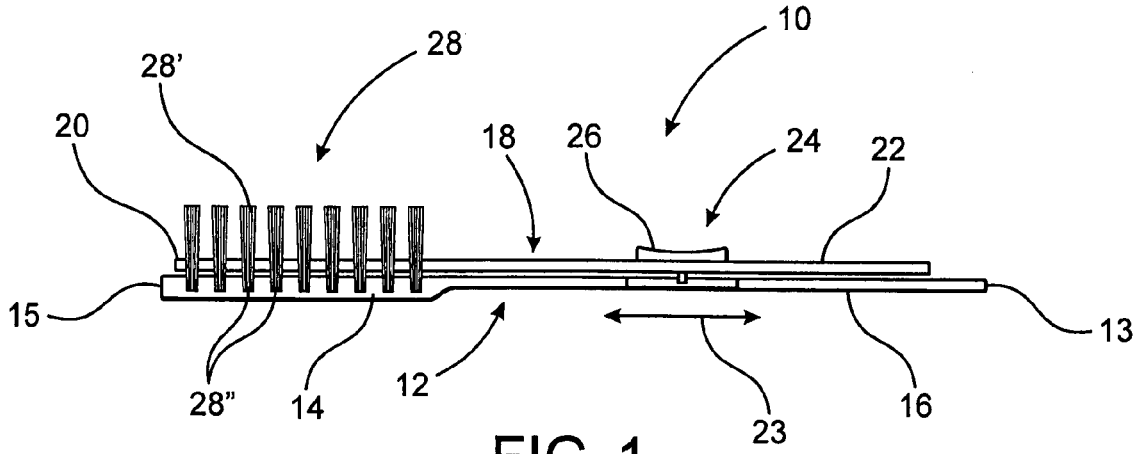
FIG. 1 is a side view of one preferred embodiment of a bristle orientation assembly of the present invention.
Figure 2:
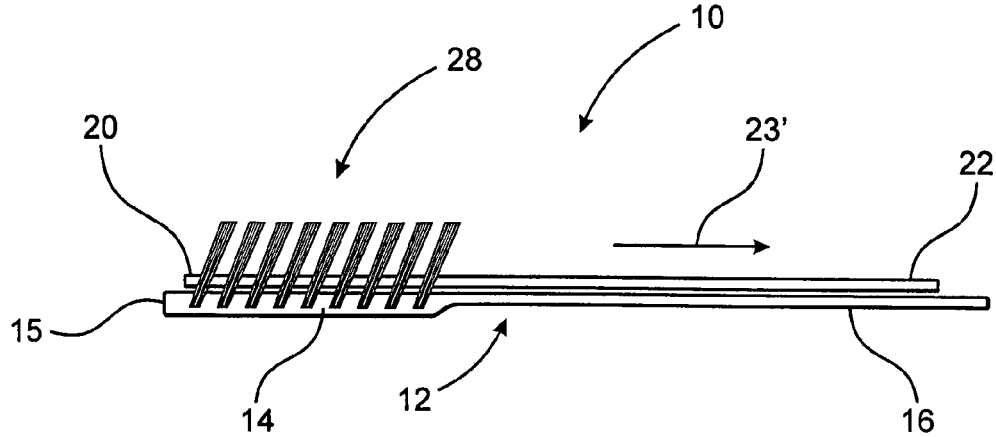
FIG. 2 is a side view in partial cutaway of one operative position of the bristles utilizing the embodiment of FIG. 1.
Figure 3:
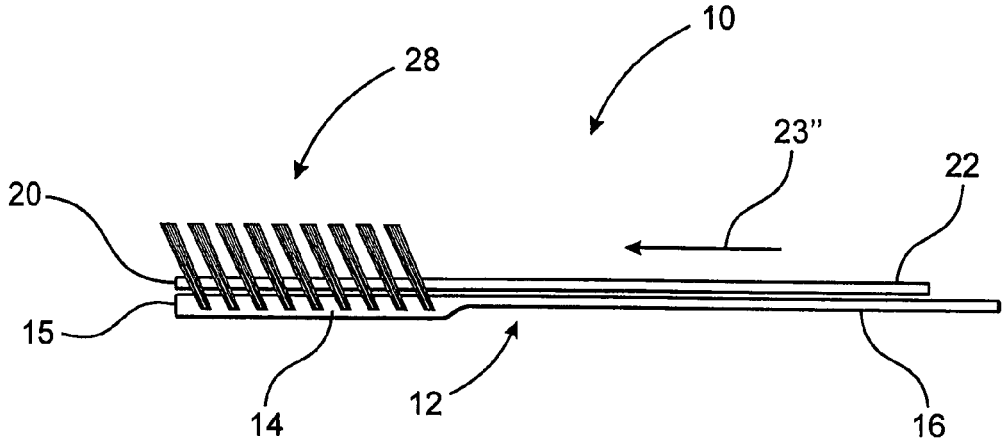
FIG. 3 is a side view in partial cutaway of another operative position of the bristles utilizing the embodiment of FIG. 1.

Accordingly one preferred embodiment of the bristle orientation of the present invention is disclosed in FIGS. 1-3. As such, the bristle orientation assembly is generally indicated as 10 and comprises a toothbrush body generally indicated as 12. The brush body 12 includes a head portion 14 and an elongated handle 16. In addition, this preferred embodiment includes a positioning assembly generally indicated as 18. The positioning assembly 18 comprises a bristle engaging portion 20 and an elongated base 22 integrally or otherwise fixedly secured to the bristle engaging portion 20 and extending outwardly therefrom. Moreover the base 22 of the positioning assembly 18 extends along the length of the body 12 and more specifically the handle portion 16 thereof. The specific length of the base 22 should be sufficient to operatively move at least the bristle engaging portion 20, relative to the toothbrush body 12 while gripping the toothbrush body 12 in a somewhat conventional fashion. Therefore, the length of the base 22 may be equal to, greater than or less than the length of the handle 16.

The embodiment of FIGS. 1-3 is structurally characterized by the fact that the positioning assembly 18 is mounted on or connected to the exterior of the toothbrush body 12. In addition, the relative dimensions, configurations and overall structuring of both the positioning assembly 18 and the toothbrush body 12 is such as to allow reciprocal movement of the positioning assembly 18 relative to and along length of the toothbrush body 12, as indicated by the directional arrow 23. As will be explained in greater detail hereinafter an adjustment assembly, generally indicated as 24, interconnects the positioning assembly 18 and the toothbrush body 12 in a manner which facilitates such reciprocal movement 23 of the positioning assembly 18. Moreover, reciprocal movement 23 of the positioning assembly 18 is such that the longitudinal axis of both the positioning assembly 18 and the toothbrush body 12 are maintained in a substantially parallel relation to one other during the reciprocal movement 23 and when the positioning assembly 18 and the toothbrush body 12 are disposed in any one of a plurality of operative positions.

The plurality of operative positions also specifically relate to the orientation of the plurality of bristles or bristle tufts generally indicated as 28. With reference to FIGS. 1-3, one of the plurality of operative positions comprises the plurality of bristles 28 disposed in an outwardly extending somewhat perpendicular relation to the head portion 14 and bristle engaging portion 20 as best shown in FIG. 1. Another of the plurality of operative positions is depicted in FIG. 2, wherein the plurality of bristles 28 are angularly oriented in a rearwardly facing position relative to the length of the toothbrush body 12, such as when the toothbrush bristles 28 are angularly oriented toward the distal end 13 of the body 12. Conversely, another of the plurality of operative positions comprises the plurality of bristles 28 angularly oriented in a forwardly facing direction as depicted in FIG. 3. As such, the plurality of bristles 28 are angularly oriented to face the opposite or proximal end 15 of the body 12.

It is emphasized that the plurality of operative positions may comprise the plurality of bristles 28 disposed at a variety of angular orientations other than those specifically disclosed in FIGS. 2 and 3. More specifically the specific angular orientation of the plurality of bristles 28, whether facing rearwardly or forwardly, may be more extreme or may be closer to a substantially perpendicular or upright orientation as shown in FIG. 1. The neutral operative position of FIG. 1 and the rearwardly and forwardly angular operative positions are depicted as being representative examples only of a plurality of operative positions which may be assumed by the bristles 28.

Figure 4:
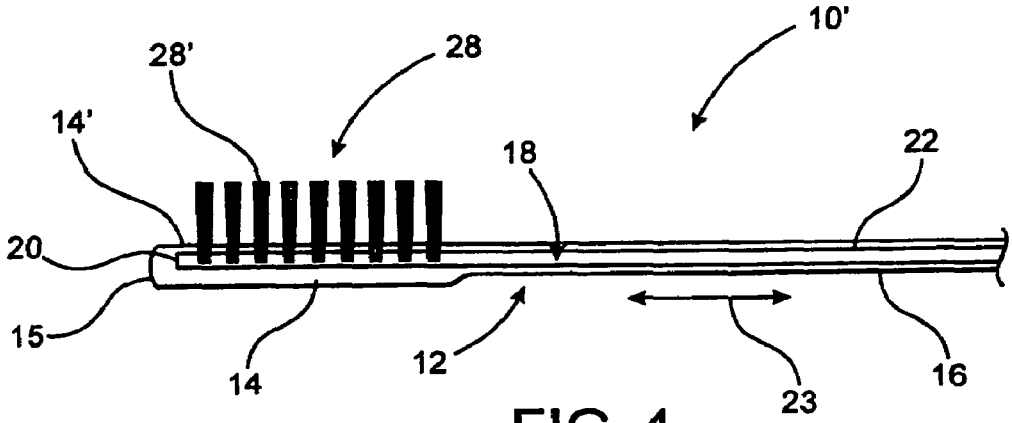
FIG. 4 is a side view in partial cutaway of another preferred embodiment of a bristle orientation assembly of the present invention.
Figure 5:
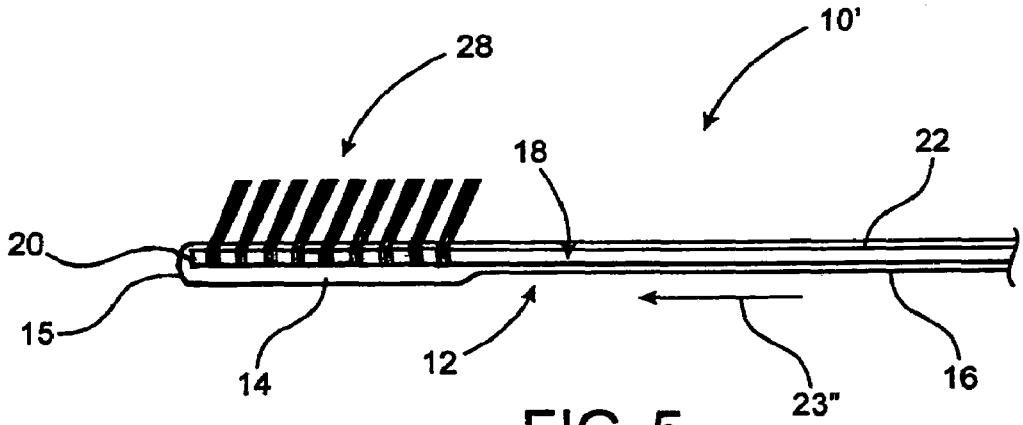
FIG. 5 is a side view in partial cutaway disclosing one of the plurality of operative positions of the bristles utilizing the preferred embodiment of FIG. 4.
Figure 6:
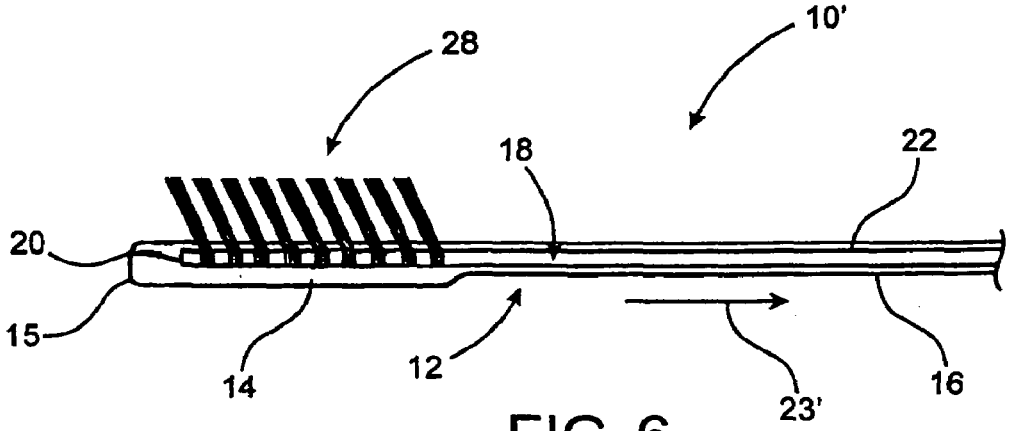
FIG. 6 is a side view partial cutaway of another operative position of the bristles, differing from that of FIG. 5 utilizing the preferred embodiment of FIG. 4.

Yet another preferred embodiment of the present invention is disclosed in FIGS. 4-6. As shown therein, this embodiment is structurally distinguishable from the preferred embodiment of FIGS. 1-3 by the movable mounting of the positioning assembly 18 on an interior portion of the toothbrush body 12. While the preferred embodiment of FIGS. 4-6 includes substantially the entire positioning assembly 18 mounted on an interior of the brush body 12, it is emphasized that structural variations thereof may include at least the bristle engaging portion 20 being mounted on an interior of the head portion 14 of the toothbrush body 12.

Similarly the positioning assembly 18 is reciprocally moveable, as indicated by directional arrows 23, 23' and 23", such that the positioning assembly 18 may be moved along the length of the brush body 12 in opposite directions so as to dispose the plurality of bristles 28 in any of the aforementioned plurality of operative positions. As such, the embodiment of FIGS. 4-6 defines the operative positions to include the neutral position of FIG. 4, wherein the bristles 28 extend transversely or perpendicularly outward from the head portion 14. Another of the possible plurality of operative positions include the plurality of bristles being angularly oriented in a rearwardly facing direction as indicated in FIG. 5. Also, the plurality of operative positions include the angular orientation of the plurality of bristles in a forward facing direction relative to the length of the toothbrush body 12.

Distinguishing operational features between the preferred embodiment of FIGS. 1-3 and the preferred embodiment of FIGS. 4-6 include the relative movement and or disposition of the positioning assembly 22 relative to the toothbrush body 12 as further indicated by the directional arrows 23, 23', and 23" depicted in both the embodiments of FIGS. 1-3 and 4-6.

Figure 7:
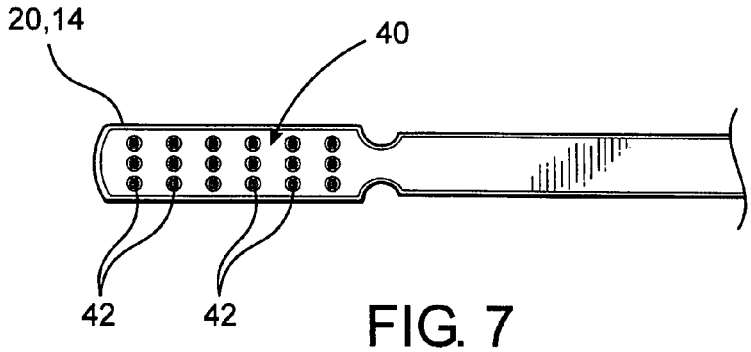
FIG. 7 is a top view of yet another preferred embodiment of the bristle orientation assembly of the present invention.
Figure 8:
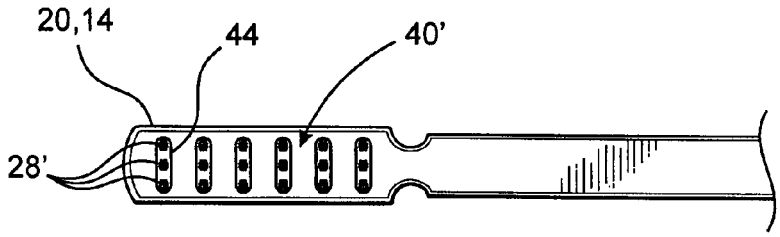
FIG. 8 is top view of yet another preferred embodiment of the bristle orientation assembly of the present invention.

In order to obtain disposition of the plurality of bristles 28 in any of the preferred operative positions, whether utilizing or applying the preferred embodiment of FIGS. 1-3 or the preferred embodiment of FIGS. 4-6, either the positioning assembly 20 or the head portion 14 must include an apertured construction. With specific reference to FIGS. 7 and 8, the bristle engaging portion 20, of FIGS. 1 through 3, has the aforementioned apertured construction 40 formed therein. Apertured construction of the bristle engaging portion 20 as depicted in FIGS. 1-3 may include a plurality of individual openings 42 each disposed, configured and dimensioned to allow a single bristle or single grouping or tuft of bristles 28' to extend there through. The base of each of the individual bristle or bristle tufts 28' is fixedly secured or anchored into the head portion 14 of the toothbrush body 12. Alternatively, the apertured construction 40' as depicted in FIG. 8 may include a plurality of openings 44 each aligned, dimensioned and configured to receive a plurality of individual bristles or plurality of bristle tufts 28' therethrough. Further in the embodiment of FIG. 8 the enlarged openings 44 are disposed substantially transverse to the length of the toothbrush body 12.

Accordingly, positioning of the plurality of bristles 28 in a neutral, operative position as shown in FIG. 1 is defined by the plurality of openings 42 or 44 of the apertured construction 40 and 40' respectively disposed in substantially aligned relation with the perpendicular orientation of the individual bristles or bristle tufts 28'. Disposition of the plurality of bristles 28 in a rearwardly facing direction, in accordance with FIG. 2, is accomplished by a rearward travel of the positioning assembly 22 as indicated by directional arrow 23'. Such rearward movement 23' forces a realignment of the plurality of openings 42 or 44 causing the rearwardly facing angular orientation as should be obvious. Conversely the forward orientation of the plurality of bristles 28 is caused by a forward travel or movement of the positioning assembly 22 as indicated by directional arrow 23" of FIG. 3. When such forward travel 23' occurs, the openings 42 or 44 again become realigned so as to force the plurality of bristles 28 in the forwardly facing direction depicted in FIG. 3.

However, in the preferred embodiment of FIGS. 4-6, the positioning assembly 18 is located on the interior of the toothbrush body 12. Therefore the apertured construction 40 and/or 40' is formed in the outermost portion 14' of the head portion 14 rather than in the bristle engaging portion 20. Also in this embodiment, the plurality bristles 28 or bristle tufts each 28' each have their base anchored in the bristle engaging portion 20 as depicted in FIGS. 4-6 rather than in the head portion 14 as depicted in FIGS. 1-3. Therefore the rearwardly facing operative position of the plurality of bristles 28, as depicted in FIG. 5, is accomplished by a forward movement or travel of the positioning assembly 18 as indicated by directional arrow 23' of FIG. 5. The forwardly facing operative position of the plurality of bristles 28 is accomplished by a rearward movement or travel of the positioning assembly 18 as indicated by directional arrow 23' of FIG. 6.

Regardless of whether the preferred embodiment of FIGS. 1-3 or the preferred embodiment of FIGS. 4-6 is utilized, the bristle orientation assembly 10 and 10' each preferably include the provision of at least one of a plurality of different embodiments of an adjustment assembly, generally indicated as 24 in FIG. 1. The structural features distinguishing the various embodiments of the adjustment assembly 24 is at least partially dependent on whether the positioning assembly 18 is moveably connected to or mounted on an exterior of the toothbrush body 12 (FIGS. 1-3) or the interior thereof (FIGS. 4-6).

Figure 9:
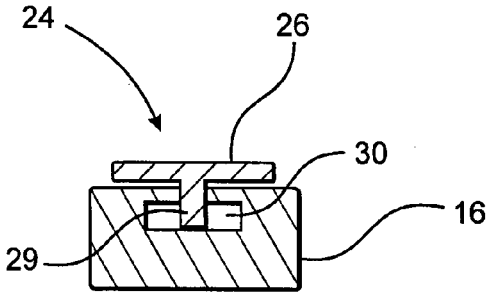
FIG. 9 is transverse sectional view of an adjustment assembly associated with the bristle orientation of the present invention.

Various structural modifications of the adjustment assembly 24 as indicated in FIGS., 9, 10 and 11, 12 are intended to be used with the embodiment of FIGS. 1-3. More specifically and with primary reference to FIGS. 9 and 10, the adjustment assembly 24 includes a finger engaging portion 26 formed on an exposed outer surface of the base 22 of the positioning assembly 18, as also depicted in FIG. 1. A connecting stub member or like structure 29 is fixedly or integrally connected to the finger engaging portion 26 and extends from beneath the undersurface thereof into the interior of the handle 16 of the toothbrush body 12. The member 29 extends through an elongated slot 30 and terminates at an enlarged head 32. The enlarged head 32 has a sufficient transverse dimension to prevent passage thereof through the slot 30. The accidental removal of the positioning assembly 18 from the base 22 is thereby prevented.

Figure 10:
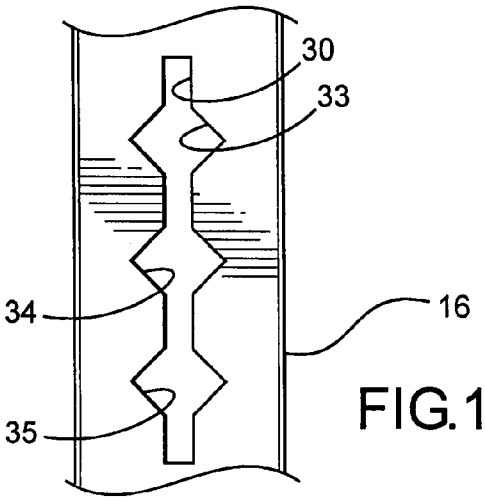
FIG. 10 is a top view in partial cutaway of the embodiment of FIG. 9 with portions of the adjustment assembly removed.

As disclosed in FIG. 10, a plurality of stop or lock recesses 33, 34 and 35 may extend along the length of the slot 32 in predetermined spaced relation to one another. Each of the recesses 33-35 may be relatively disposed to one another so as to facilitate the positioning of the bristle engaging portion 20 in any of the aforementioned operative positions as described with reference to FIGS. 1-3. Further, the actual dimension and configuration of each of the recesses 33-35 may be cooperatively determined along with either the dimension and configuration of the member 29 and/or enlarged head 30 so as to temporarily stop the finger engaging portion 26 in anyone of the respective recesses 33-35. However, easy removal of the finger engaging portion from the recesses 33-35 is accomplished when an additional, substantially minimal, force is exerted on the finger engaging portion 26. As such, the respective recess is 33-35 will define locking locations for the various brush, operative positions as described with reference to FIGS. 1-3.

While the embodiments of FIGS. 1 through 3 describe the selective positioning of the bristles 28 by relative orientations or positions of the positioning assembling 18 and the toothbrush body 12, other examples of selectively positioning the bristle assembly 28 comprise the inclusion of a ratchet-type assembly and/or a gear structure independently or collectively defining a mechanical linkage for accomplishing relative movement between the positioning assembly 18 and the toothbrush body 12 in addition to or independent of the embodiments disclosed FIGS. 1 through 3, as set forth above.

Figure 11:
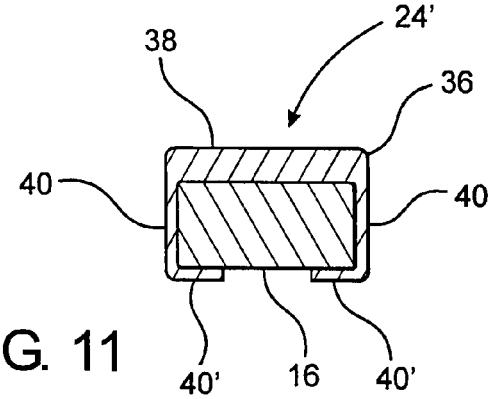
FIG. 11 is a transverse sectional view of yet another embodiment of the adjustment assembly of the bristle orientation assembly of the present invention.
Figure 12:
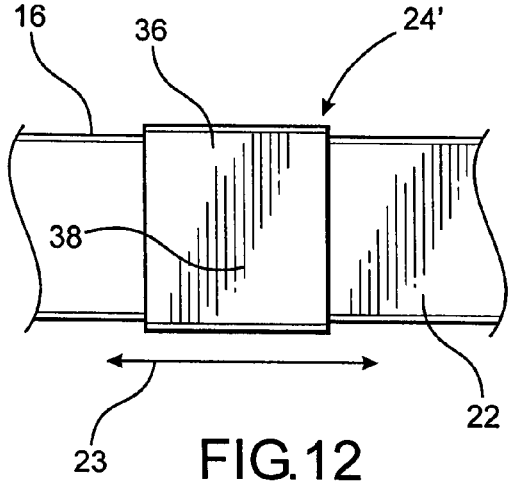
FIG. 12 is a top view in partial cutaway of the embodiment of FIG. 11.
Figure 13:
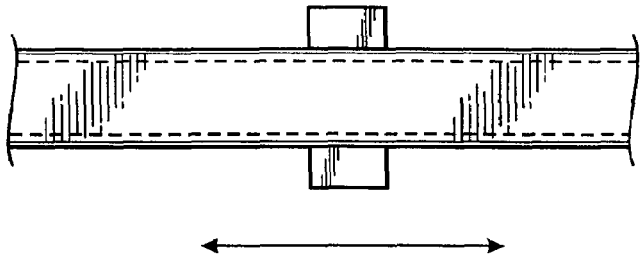
FIG. 13 is a top view in partial cutaway in phantom showing yet another preferred embodiment of the adjustment of the present invention.
Figure 14:
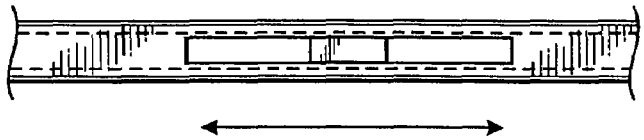
FIG. 14 is side view in partial cutaway and phantom of the embodiment of FIG. 13.

With reference to FIGS. 11 and 12, the positioning assembly is indicated as 24' and includes an externally mounted clip like structure 36. The clip 36 has an outer exposed surface 38 intended to be engaged by the finger or other portion of the hand of the user. In addition, the clip 36 includes depending legs 40 extending over and at least partially surrounding the opposite longitudinal sides of the handle 16. As such, the outermost extremities of the clip 36 as at 40' slideably "grip" the undersurface of the handle 16. In addition, the undersurface of the clip 36, preferably in the area beneath the finger engaging portion 38, is fixedly or integrally secured to the base 22 of the positioning assembly 18. Exertion of force by a finger or other portion of the hand of the user will serve to easily move the adjustment assembly 24' in either of the opposite directions defining the reciprocal direction of travel 23, as described above with reference to FIGS. 1-3.

Figure 15:
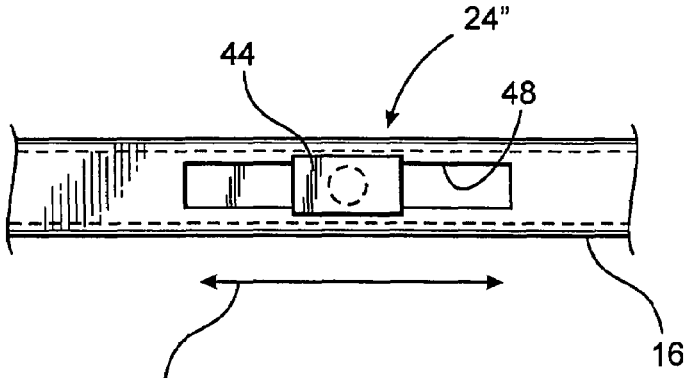
FIG. 15 is top view in partial cutaway and phantom of yet another preferred embodiment of the present invention.
Figure 16:
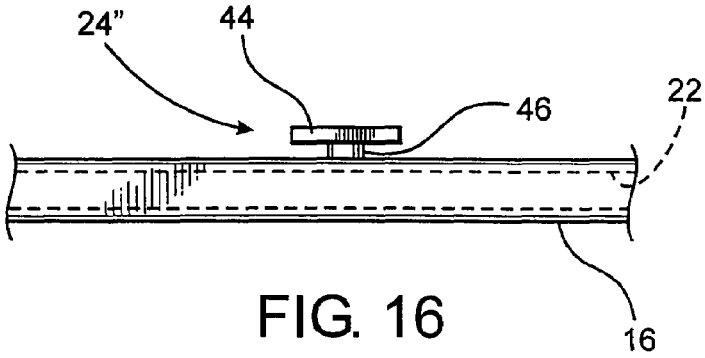
FIG. 16 is side view in partial cutaway and phantom of the embodiment of FIG. 15.

Yet another preferred embodiment of the adjustment assembly 24" is disclosed in FIGS. 15 and 16. This embodiment is primarily structured for use in combination with the preferred embodiment of the bristle orientation assembly 10' as disclosed in FIGS. 4-6. More specifically, the positioning assembly 24" includes a finger engaging portion 44 fixedly or integrally connected to base 22 of the positioning assembly 18 when the positioning assembly 18 is disposed on the interior of the handle 16 of the toothbrush body 12. Interconnection there between occurs by a stub or finger 46 dimensioned to reciprocally travel in opposite directions within a groove or slot 48 formed in the handle 16. Therefore, disposition of the bristles 28 in either of the operative positions of FIGS. 4-6 is accomplished by exerting a force, using the finger or other portion of the hand of the user, on the finger engaging portion 44, fixedly secured to the base 22 and thereby causing the base to move in either of the reciprocal directions 23' or 23".

Since many modifications, variations and changes in detail can be made to the described preferred embodiment of the invention, it is intended that all matters in the foregoing description and shown in the accompanying drawings be interpreted as illustrative and not in a limiting sense. Thus, the scope of the invention should be determined by the appended claims and their legal equivalents.

Now that the invention has been described,

What is claimed is:

1. An assembly structured to adjustably orient bristles of a toothbrush, said assembly comprising:

a toothbrush body including a head portion and a plurality of bristles extending outwardly from said head portion, a positioning assembly moveably connected to said toothbrush body and reciprocally movable along a longitudinal axis thereof, and said positioning assembly comprising a bristle engaging portion cooperatively disposed and structured with said head portion to collectively position said plurality of bristles in different angular orientations, and said plurality of said bristles being fixedly secured to said bristle engaging portion and disposed in moveable engagement with said head portion.

2. An assembly as recited in claim 1 wherein said positioning assembly is at least partially disposed on an interior of said body.

3. An assembly as recited in claim 1 wherein said bristle engaging portion is moveably mounted within said head portion.

4. An assembly as recited in claim 3 wherein said head portion comprises an apertured construction including a plurality of openings disposed and configured to have said plurality of bristles extending through said head portion.

5. An assembly as recited in claim 4 wherein at least some of said plurality of openings are dimensioned and configured to receive a single bristle tuft there through.

6. An assembly as recited in claim 4 wherein at least some of said plurality of openings are dimensioned and configured to receive a plurality of bristle tufts there through.

7. An assembly as recited in claim 6 wherein at least some of said plurality of openings comprise an elongated configuration disposed in receiving relation with aligned ones of said plurality of bristle tufts.

8. An assembly as recited in claim 6 wherein at least some of said plurality of openings comprise an elongated configuration disposed in receiving relation with consecutively aligned ones of said plurality of bristle tufts.

9. An assembly as recited in claim 1 wherein said bristle engaging portion is cooperatively disposed and structured with said head portion to selectively position said plurality of bristles in either of at least a forward or rearward angular orientation relative to said head portion.

* * * * *